US005315723A

United States Patent [19]

Smith

[11] Patent Number: 5,315,723

[45] Date of Patent: May 31, 1994

[54] PORTABLE PATIENT TURNING AND LIFTING APPARATUS

[75] Inventor: Gene A. Smith, Shallotte, N.C.

[73] Assignee: Ary Lift, Inc., Shallotte, N.C.

[21] Appl. No.: 942,307

[22] Filed: Sep. 9, 1992

Related U.S. Application Data

[60] Continuation-in-part of Ser. No. 801,641, Dec. 2, 1991, Pat. No. 5,161,267, which is a division of Ser. No. 718,971, Jun. 21, 1991, Pat. No. 5,068,931, and a continuation-in-part of Ser. No. 801,642, Dec. 2, 1991, Pat. No. 5,235,712, which is a continuation-in-part of Ser. No. 718,971, Jun. 21, 1991, Pat. No. 5,068,931.

[51] Int. Cl.[5] ..... A61G 7/10; A61G 7/14

[52] U.S. Cl. ..... 5/85.1; 5/88.1

[58] Field of Search ..... 5/81.1–89.1

[56] References Cited

U.S. PATENT DOCUMENTS

| | | | |
|---|---|---|---|
| 545,741 | 9/1895 | Shutters | 5/88.1 |
| 680,814 | 8/1901 | Smith . | |
| 904,587 | 11/1908 | Wible . | |
| 1,263,611 | 4/1918 | Scroggin | 5/88.1 |
| 2,100,663 | 11/1937 | Maddox | 5/85.1 |
| 2,283,511 | 5/1942 | Sellers et al. | 5/88.1 |
| 2,603,851 | 7/1952 | Hawkins | 5/85.1 |
| 2,629,108 | 2/1953 | Wickey | 5/84.1 |
| 3,383,717 | 5/1968 | Underwood | 5/88.1 |

*Primary Examiner*—Alexander Grosz
*Attorney, Agent, or Firm*—W. Thad Adams, III

[57] ABSTRACT

A portable invalid patient lifting and turning apparatus, including an open framework for being positioned above a bed for lifting and lowering a patient. The framework includes a first pair of upright standards mounted on rolling means and a second pair of standards mounted on rolling means and spaced apart from the first pair of standards. Interconnecting frame members define a lengthwise dimension of the apparatus, and are connected to the first and second pairs of upright standards by opposite ends of the frame members. The first pair of standards are mounted for pivotal movement about a vertical axis and moveable between a first position wherein the at least one pair of standards is positioned substantially in alignment with the length of the framework to define a space between the first and second pairs of legs of a dimension sufficient to permit the framework to be moved laterally over a bed, and a second position wherein the first pair of standards is positioned in outwardly-extending relation substantially perpendicular to the length of the bed for permitting the framework to be moved along its lengthwise axis over a bed. In this way the apparatus can be conveniently moved into position either from the side or the end of patient beds and moved out of position for patient transport or for movement to another patient location.

8 Claims, 10 Drawing Sheets

PORTABLE PATIENT TURNING AND LIFTING APPARATUS

TECHNICAL FIELD AND BACKGROUND OF THE INVENTION

This application is a continuation-in-part of application Ser. No. 801,641, filed Dec. 2, 1991 now U.S. Pat. No. 5,161,267, which is a division of application Ser. No. 718,971, filed Aug. 21, 1991, now U.S. Pat. No. 5,068,931; and a continuation-in-part of application Ser. No. 801,642 filed Dec. 21, 1991, now U.S. Pat. No. 5,235,712, which is a continuation-in-part of application Ser. No. 718,971, filed Jun. 21, 1991 now U.S. Pat. No. 5,068,931.

This invention relates to a portable apparatus for turning and lifting bedridden patients. The apparatus has a construction which permits the framework of the apparatus to be adjusted so that it can be moved over a patient bed from the front or rear, from the sides, and can easily fit into elevators when moving patients from one floor to another in a multi-story facility. The ability to easily lift and turn a patient permits the patient to be easily bathed, dressed and undressed, exercised and otherwise cared for in ways which are difficult or impossible when the patient cannot be removed from the bed and therefore must be moved around on the surface of the bed. The ability to lift and suspend the patient above the surface of the bed permits easy and frequent changes of bed linens. These features substantially reduce staff labor and the amount of time required to properly and compassionately attend to a patient's physical and sanitary needs, reduce odors, skin infections and bed sores, and substantially improves the overall level of care which can be provided.

The apparatus according to the invention is equally adaptable for use in hospitals, nursing homes and in the patient's own home. In fact, the ease with which the patient can be cared for using the apparatus and method of the invention permits many patients to be cared for by their family at home, rather than being confined to a nursing home or hospital.

Typical procedures used to care for bedridden patients require that the patient be physically moved about on the surface of the bed. Bathing the patient is a particular problem, since improper or infrequent bathing can promote infection, odor, skin sores and a general debilitation of the patient.

Constant contact between the patient and the bed almost insures re-soiling of either the patient or the bed linens since both cannot be cleaned at the same time.

The apparatus according to the application permits a single unit to be in almost continual use, either lifting patients so they and/or their bed lines can be cleaned, or transporting patients from place to place within the care facility.

SUMMARY OF THE INVENTION

Therefore, it is an object of the invention to provide an apparatus which permits a bedridden patient to be lifted and suspended above the bed while the bed linens are changed.

It is another object of the invention to provide an apparatus which permits a bedridden patient to be bathed while suspended above the bed.

It is another object of the invention to provide an apparatus which permits a bedridden invalid patient to be turned from side-to-side while on the bed.

It is another object of the invention to provide an apparatus which can be rolled into position over a conventional bed either from the front, back or sides.

It is another object of the invention to provide an apparatus which can be rolled from bed-to-bed or to bathing or other stations with the patient suspended thereon.

It is another object of the invention to provide an apparatus which can be rolled from bed-to-bed or to bathing or other stations while empty whereby a single apparatus can service numerous patients.

It is another object of the invention to provide an apparatus which can be shortened so that it will fit within a standard hospital-sized elevator.

It is another object of the invention to provide a method of attending to various parts of the patient by selective removal of the means by which the patient is suspended above the bed.

These and other objects of the present invention are achieved in the preferred embodiments disclosed below by providing a portable invalid patient lifting and turning apparatus, including an open framework for being positioned above a bed for lifting and lowering a patient. The framework comprises a first pair of upright standards mounted on rolling means and a second pair of standards mounted on rolling means and spaced apart from the first pair of standards. Interconnecting frame members define a lengthwise dimension of the apparatus, and are connected to the first and second pairs of upright standards by opposite ends of the frame members.

The first pair of standards are mounted for pivotal movement about a vertical axis and moveable between a first position wherein the at least on pair of standards is positioned substantially in alignment with the length of the framework to define a space between the first and second pairs of legs of a dimension sufficient to permit the framework to be moved laterally over a bed, and a second position wherein the first pair of standards is positioned in outwardly-extending relation substantially perpendicular to the length of the bed for permitting the framework to be moved along its lengthwise axis over a bed. In this way the apparatus can be conveniently moved into position either from the side or the end of patient beds and moved out of position for patient transport or for movement to another patient location. Elevator means are supported by the open framework and patient support means are positioned on a mattress of the bed underneath the patient. Connecting means connect the patient support means and the elevator means thereby permitting the patient support means to lift the patient above the mattress surface for cleaning and bed-linen changing.

According to one preferred embodiment of the invention, the first pair of standards are moveable to a third position wherein the first pair of standards is moveable to a position substantially 165 from the first position, with the standards residing along the side of the interconnecting frame members in order to shorten the overall length of the apparatus to permit movement in and around tight spaces and onto elevators.

According to another preferred embodiment of the invention, the rolling means comprise casters.

According to yet another preferred embodiment of the invention, locking means are provided for locking the first pair of standards into the chosen first, second or third position.

According to another preferred embodiment of the invention, each of the standards comprising the first pair of standards comprises a first, vertical segment and a second, horizontal segment, each of the standards being pivotally attached to the frame members by an end of the horizontal segment to provide increased distance between the first and second pairs of standards when the first pair of standards is in its first position, and increased distance between the standards of the first pair of standards when the standard are in the second position.

According to yet another preferred embodiment of the invention, the first and second standards each comprise first and second tubular legs joined along the length of the vertical segment.

According to yet another preferred embodiment of the invention, the first and second standards define a ninety-degree transition curve at the point where the horizontal segment and the vertical segment join.

According to yet another preferred embodiment of the invention, the first and second tubular legs are vertically spaced-apart at the point where they are attached to the frame members.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
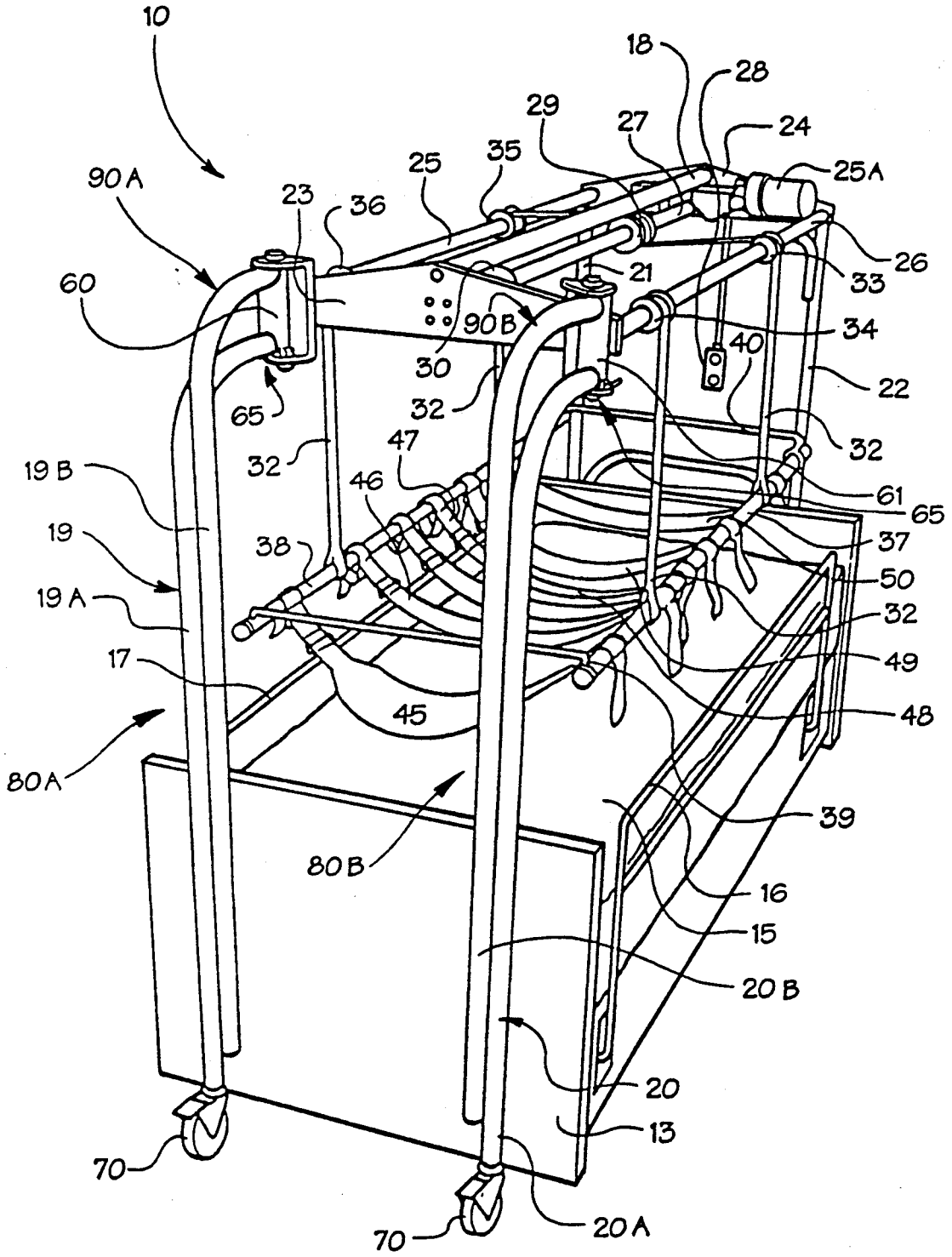
FIG. 1 is a perspective view of an apparatus for lifting and turning an invalid patient positioned on a hospital bed.

Referring now specifically to the drawings, a portable apparatus for lifting and turning a patient according to the present invention is illustrated in FIG. 1 and shown generally at reference numeral 10. Lifting apparatus 10 is intended to be positioned over a standard bed, for example a standard hospital bed 13. Bed 13 includes a mattress 15 and vertically adjustable side rails 16 and 17.

Figure 4:
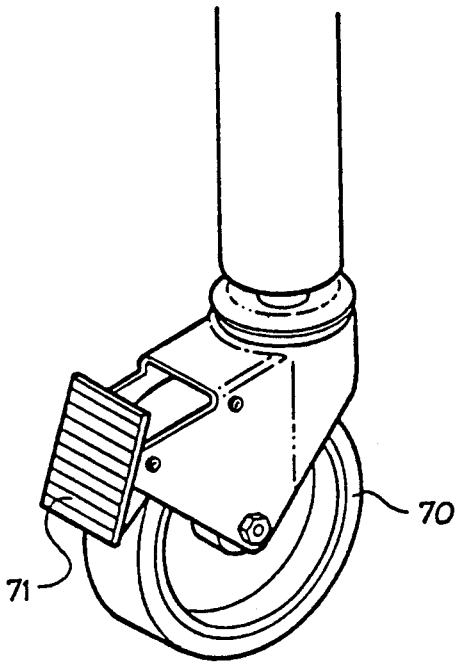
FIGS. 4 and 5 are enlarged fragmentary views showing the means of locking the caster wheels of the apparatus.
Figure 5:
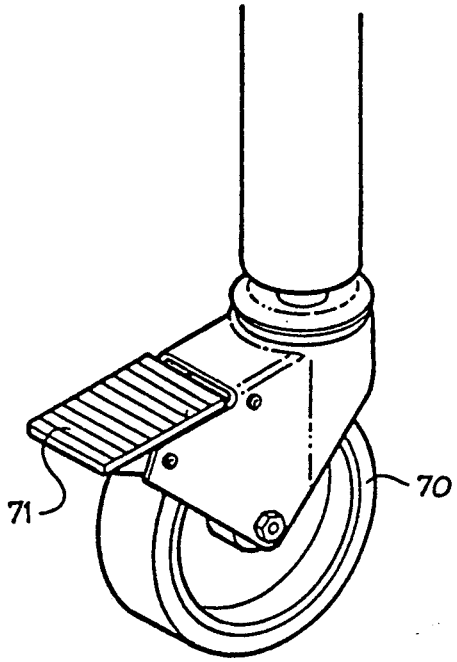
Figure 6:
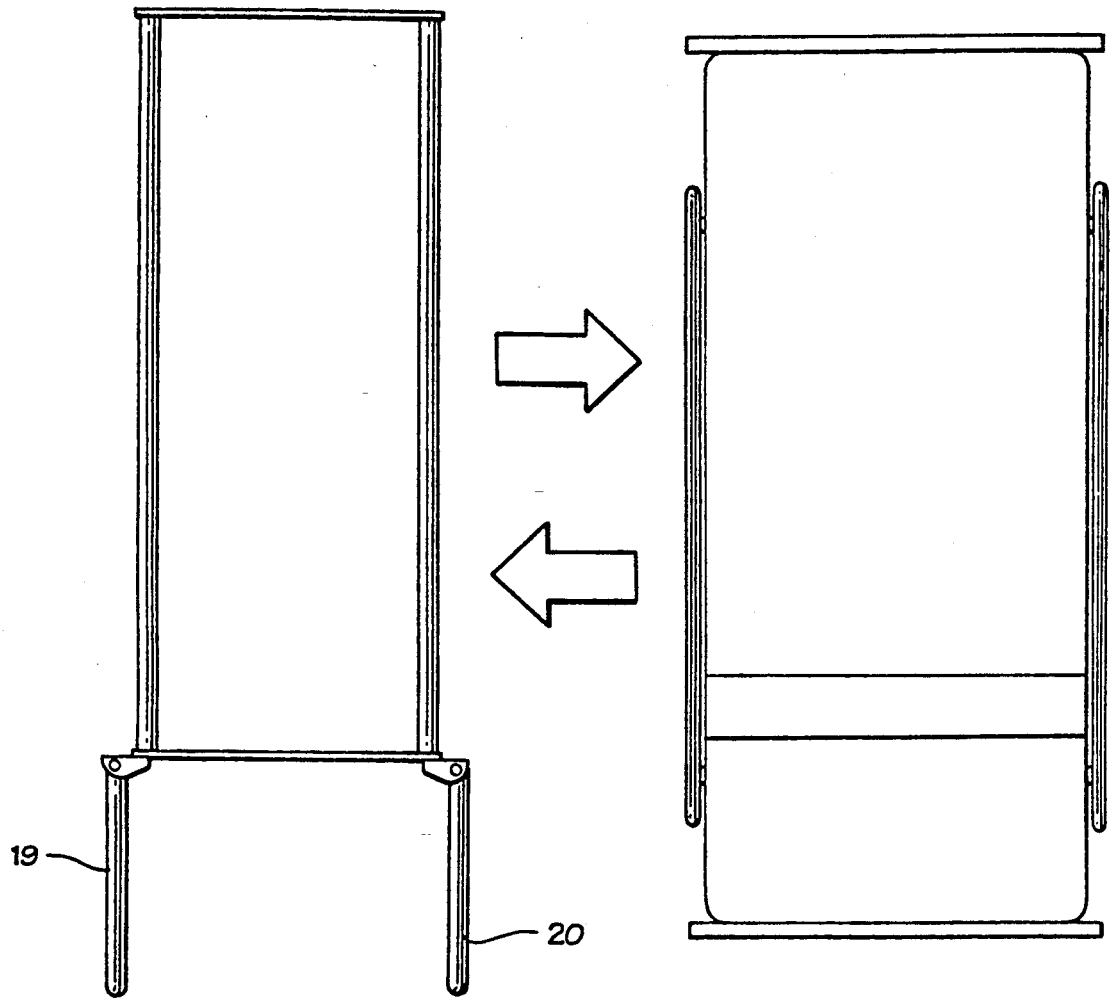
FIG. 6 is a simplified top plan view showing the apparatus in the first position for moving over the bed from the side.

Lifting apparatus 10 is comprised of on open framework which includes a first pair of upright standards 19, 20 and a second pair of upright standards 21 and 22. The pairs of standards 19, 20 and 21, 22 are attached to respective head end and foot end supports 23, 24, respectively. Each standard 19 and 20 of the first pair of standards 19, 20 includes a vertical segment 80A and 80B, respectively, and a horizontal segment 90A and 90B, respectively. The standards 19, 20 and 21, 22 are supported by respective caster wheels 70, each provided with a lock 71 to lock the apparatus 10 into place when desired. As is shown in FIGS. 4 and 5, the lock 71 can be moved by foot pressure between an unlocked position permitting free rolling and pivoting of the caster 70, and a locked position where the caster 70 is securely locked against movement.

The end supports 23, 24 are provided with further rigidity by a support bar 18 which is attached to and extends between the end supports 23, 24 along the top extent of the lifting apparatus 10.

Winding bar supports 23, 24, are connected together in spaced-apart relation by a pair of tubular winding bars 25, 26 which extend from one end of the lifting apparatus 10 to the other on respective sides of the lifting apparatus 10. Winding bar supports 23, 24 do not rotate.

Elevator means are provided, and include a powered system for lifting the patient. Winding bars 25 and 26 are mounted on the end supports 23, 24. A driving bar 27 is driven by a motor and gear reduction unit **25*a* mounted on end support 24. Motor and gear reduction unit 25A drives the driving bar 27** in rotation.

In the preferred embodiment a 1650 rpm, ¼ hp reversible duty single phase direct current motor is reduced through a 180 to 1 gear reduction unit. The diameter and teeth of the gearing are selected to provide 11 rpm for the driving bar 27. Of course, many other combinations of motor sizes, powers and drive arrangements are usable with suitable adjustments in gearing. A control box 28 controls operation of the motor 25A. Rotation of the driving bar 27 causes a pair of rollers 29, 30 on the driving bar 27 to rotate in either a clockwise or counterclockwise direction. Straps 32, which are wound onto the rollers 29, 30 pass over pairs of guide rollers 33, 34, and 35, 36 mounted on the winding bars 25, and 26.

Each of the rollers 29 and 30 has two straps 32 wound onto it. One of the straps 32 winds from the top of the respective roller 29 and 30 and the other winds from the bottom, so that rotation of the rollers 29 and 30 cause both of the straps 32 on each of the rollers 29 and 30 to either wind or unwind, depending on the direction of rotation.

The other end of each of the straps 32 are looped and receive respective lifting bars 37 and 38. Lifting bars 37 and 38 are kept in the proper spaced-apart distance by a pair of spreader bars 39 and 40 which extend between lifting bars 37 and 38.

Normally, lifting bars 37 and 38 are positioned at or just slightly above the upper surface of mattress 15. Spreader bar 39 is held in position by holes in the top of the end of the lifting bars 37 and 38 adjacent the head end support 23, as is shown in FIG. 1.

Figure 12:
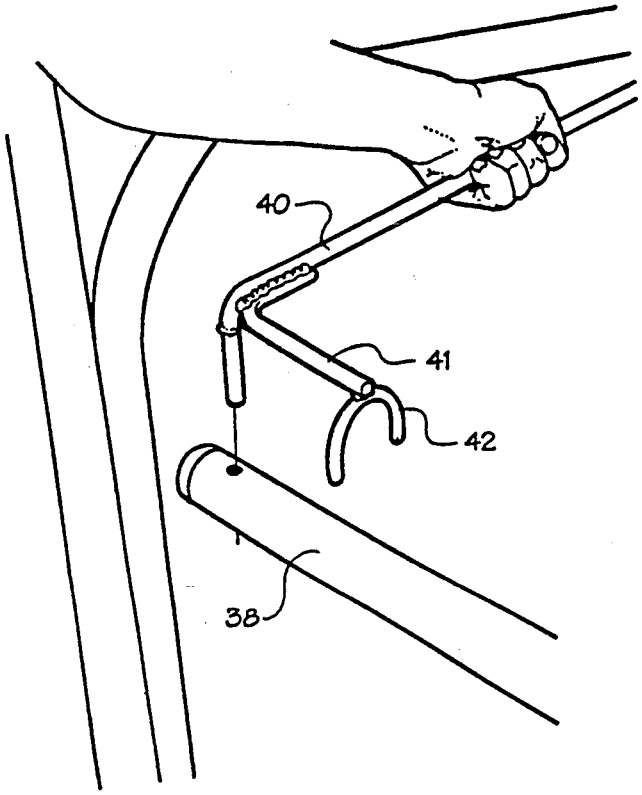
FIG. 12 is an enlarged fragmentary view showing the construction and attachment of the foot spreader bar.
Figure 13:
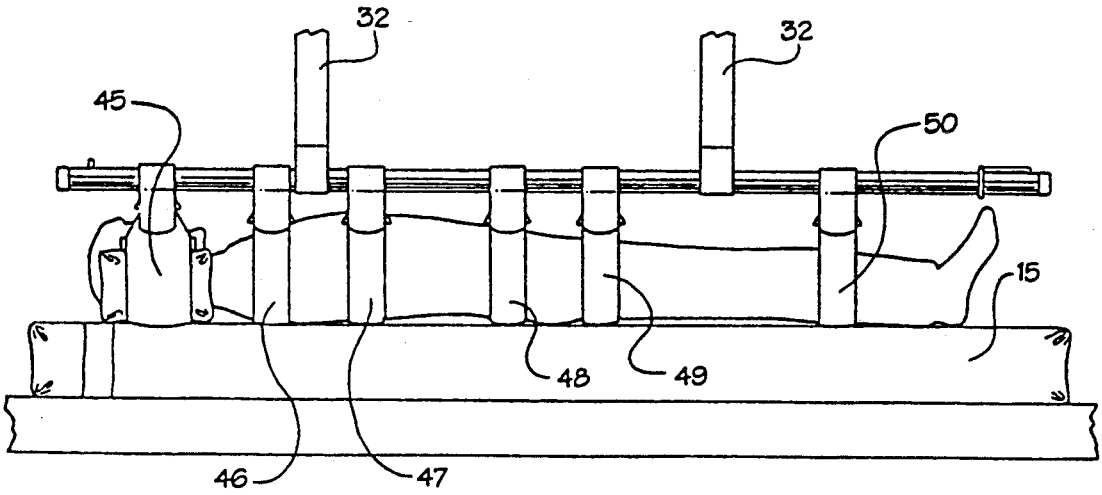
FIG. 13 is a side elevation showing correct adjustment of the lifting straps in relation to the patient.

As is best shown in FIG. 12, the spreader bar 40 is held in position by both a hole in the top of the lifting bars 37 and 38 and an outwardly extending brace 41 on opposite ends thereof, on the end of each of which is carried a downwardly-facing curved bar 42 sized to fit snugly over the top of the lifting bars 37, 38, respectively.

Figure 10:
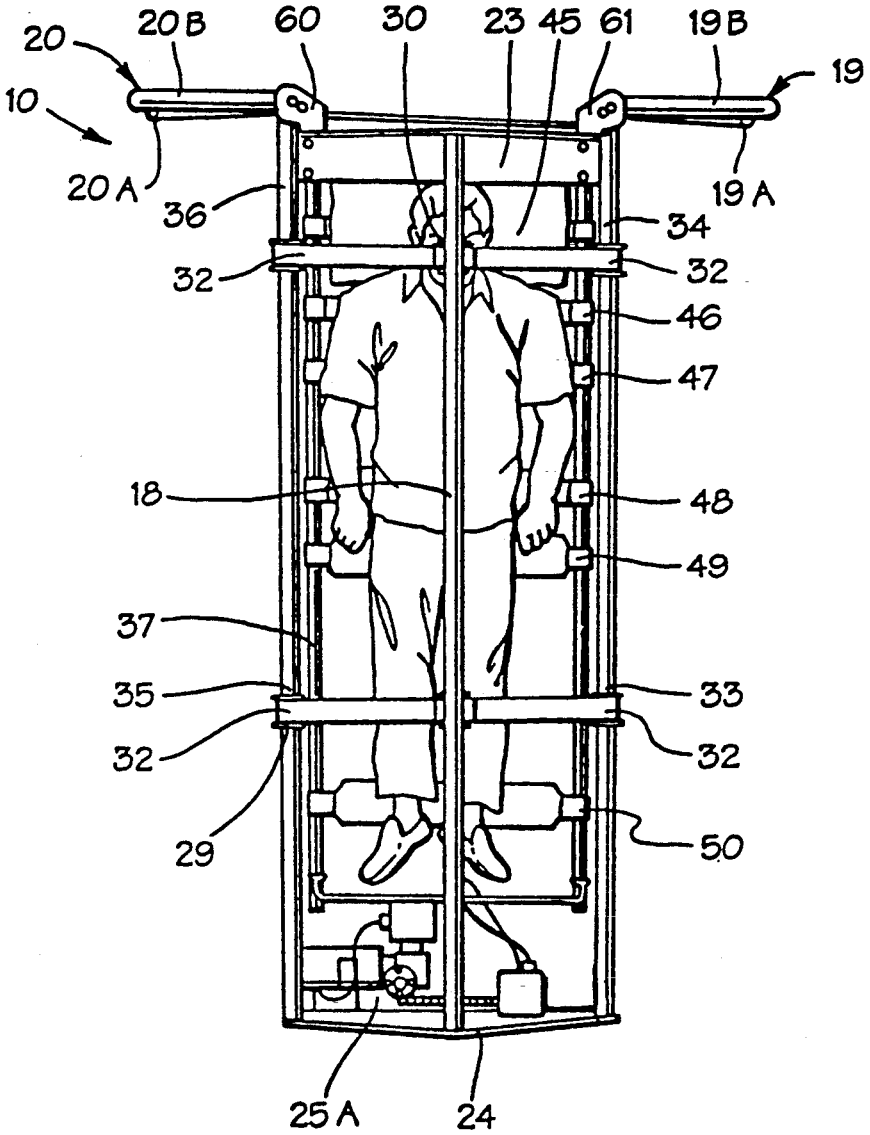
FIG. 10 is a top plan view showing the apparatus in the position for being moved over a bed from the end.

Patient support means comprise a plurality of thick lambswool covered support straps—in FIGS. 1 and 10 six such straps 45–50 are shown. Either more or fewer straps may be used depending on the size and weight of the patient, the width of the straps 45–50 and similar factors. Strap 45 is a head strap and is therefore wider. Each end of the straps 45–50 have fasteners, not shown, by which the support straps 45–50 are adjustably and securely fastened to spacing bars 37 and 38.

As is best shown in FIG. 10, the support straps 45–50 are positioned laterally, i.e., side-to-side, in spaced-apart relation along the length of the mattress 15. The spacing as well as the number of support straps 45–50 in FIGS. 1 and 10 are determined by the size of the patient and the width of the support straps 45–50. Typically, six support straps will be used for a normal sized adult patient—one for the head/neck to support a pillow; two for the upper torso, one for the lower torso/buttocks, one for the upper legs and one for the lower legs/feet.

The support straps 45–50 are positioned directly beneath the patient, not below the bed sheet, draw sheet or other bed coverings. The thick lambswool padding on the support straps 45–50 prevents irritation and, in fact, is more comfortable for the patient than lying flat on the bed 13 without the support straps 45–50. Once all of the support straps 45–50 are fastened to the spacing bars 37 and 38, the patient can be lifted by activating motor and gear reduction unit 25*a* through use of the control box 28. Normally, the patient would never need to be lifted more than about 12–15 inches off of the surface of mattress 15.

Figure 2:
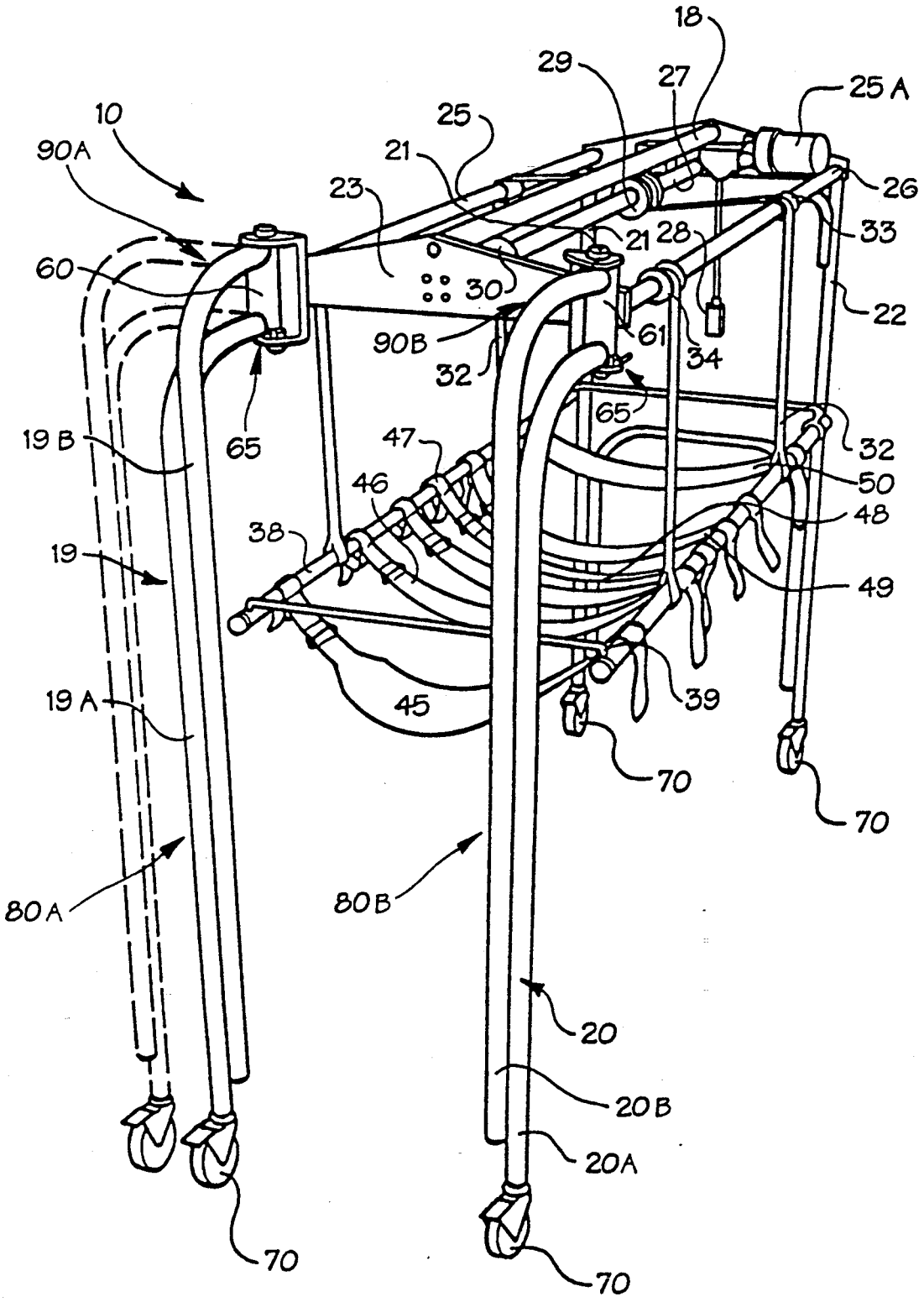
FIG. 2 is a perspective view of the apparatus shown in FIG. 1 and illustrating the movement of one of the first pairs of upright standards from the first to the second position.

Lifting apparatus 10 is a portable unit which can be moved from bed-to-bed, or which can be used to transport a patient from one bed to another or to other facilities. Standards 19 and 20 are each constructed of two separate tubular members 19A, 19B and 20A, 20B, respectively. These tubes are adjacent each other along the vertical axis from the floor to a point near the top of the lifting apparatus 10. As is best shown in FIGS. 1 and 2, the tubular members 19A,19B and 20A, 20B diverge near the top as they form a gradual right angle curve. The tubular members 19A, 19B and 20A, 20B are therefore pivotally mounted at their respective top ends to respective journals 60 and 61. Journals 60 and 61 each have a vertical axis around which the standards 19, 20 are permitted to rotate.

Figure 3:
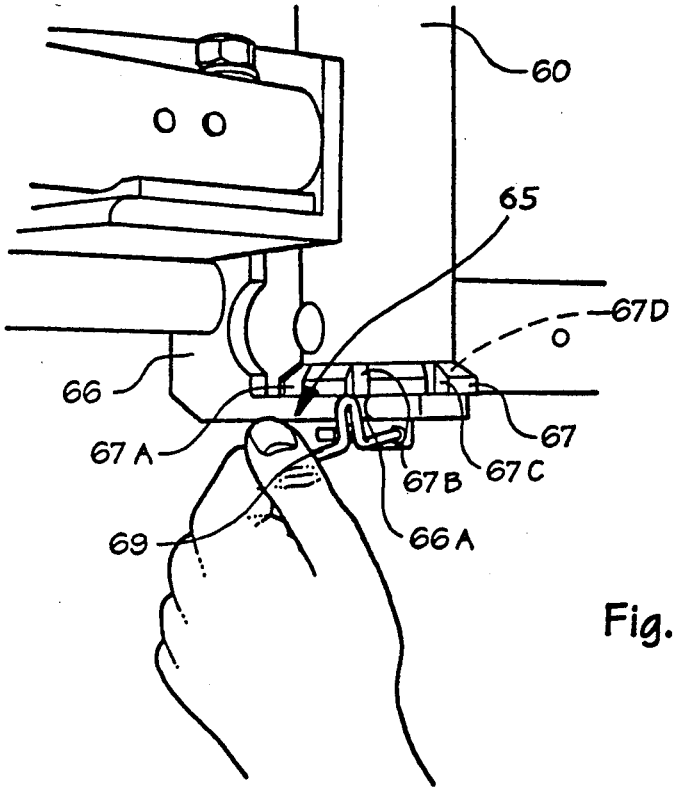
FIG. 3 is an enlarged fragmentary view showing the lock for locking the first pair of standards into its first, second and third positions.

The standards 19 and 20 are locked into position by a lock 65. As is best shown in FIG. 3, standard 19 is mounted on journal 60 by a plate 66. Plate 66 has a notch 66A in the bottom. The bottom of journal 60 has a ring 67 fixed to the bottom, with four notches 67A–D. As the standard 19 is rotated, the notch 66A progressively matches with one of the notches 67A–D. A spring-loaded locking pin 69 is slipped into a slot formed when notch 66A mates with one of the notches 67A–D in the ring 67, thus locking the standard into one of four positions, illustrated in FIGS. 8–11.

Standard 20 is locked in exactly the same way on journal 61. Three positions of the standards 19 and 20 are illustrated in FIGS. 6–11. As noted above, the lifting apparatus 10 can be moved into position over the bed 13 from the side. This position is the position shown in FIGS. 6 and 9, as well as FIGS. 1 and 2. The locking pin 69 is in notch 67A. The distance provided by the curve at the top of the standards 19 and 20 provides adequate room for the bed 13 to move freely under the lifting apparatus 10 as it is rolled over the bed 13.

Figure 7:
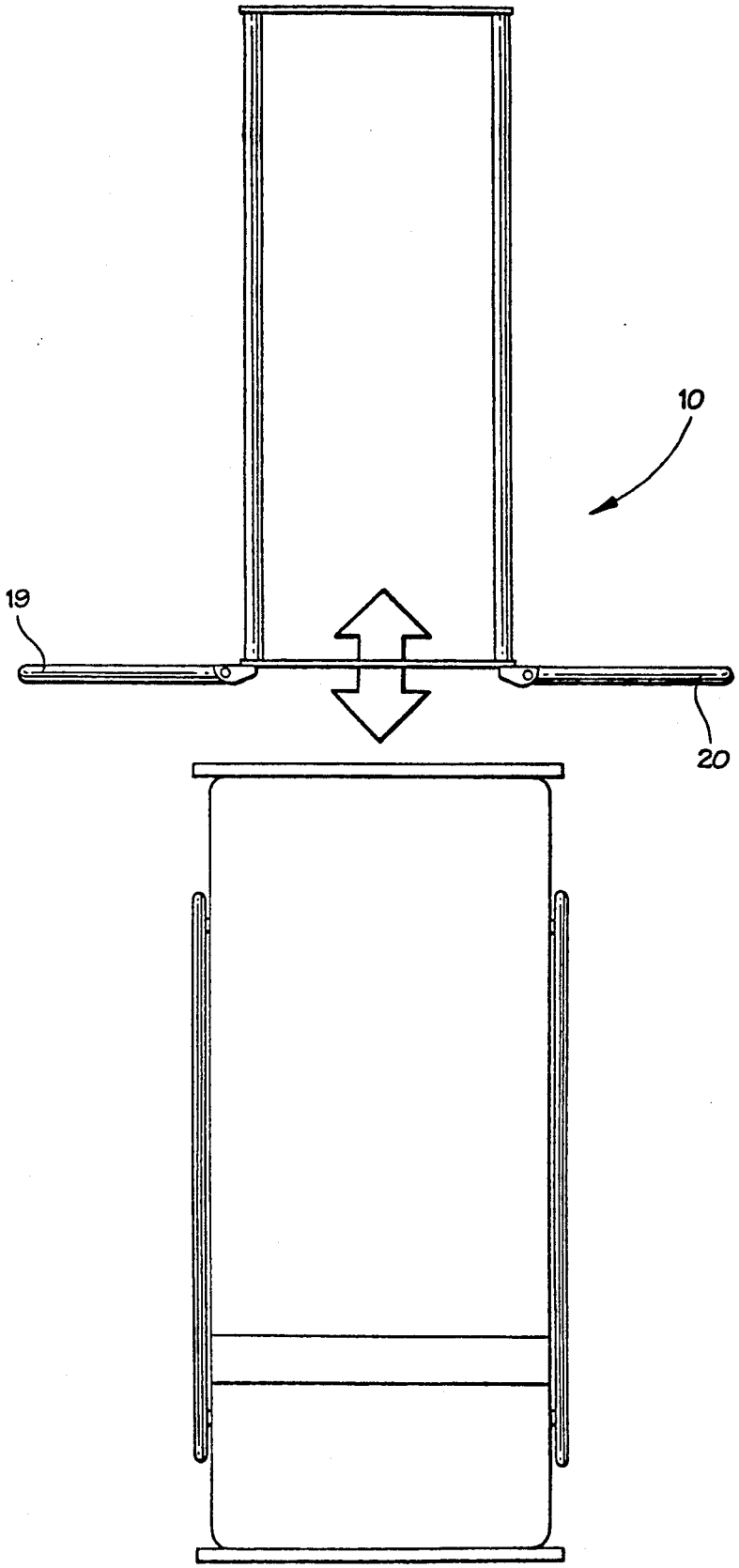
FIG. 7 is a simpified top plan view showing the apparatus in the second position for moving over the bed from the front.

FIGS. 7 and 10 illustrate the method by which the lifting apparatus 10 is moved over the bed 13 from the end. The standards 19, 20 moved to the position where they are at substantially at right angles to the length of the lifting apparatus 10. This moves the legs 19, 20 out of the way to provide clearance for the wider bed 13. The locking pin 69 is in notch 67C.

Figure 9:
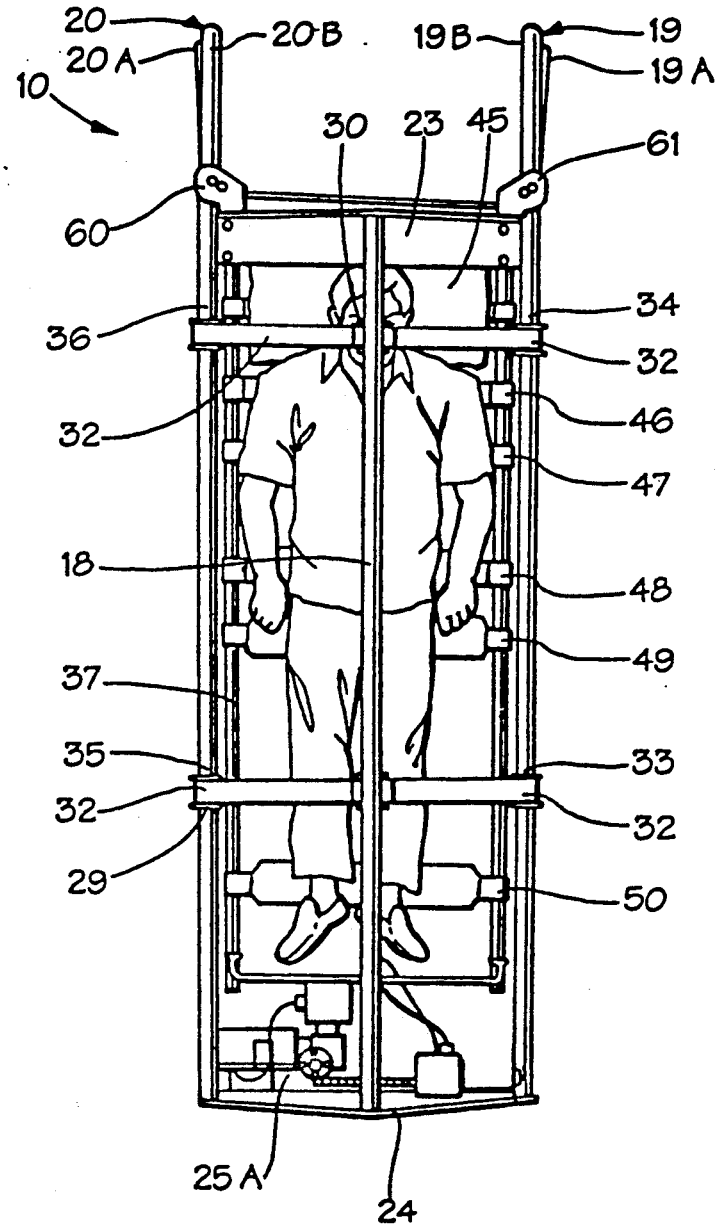
FIG. 9 is a top plan view showing the apparatus in the position for being moved over a bed from the side.
Figure 11:
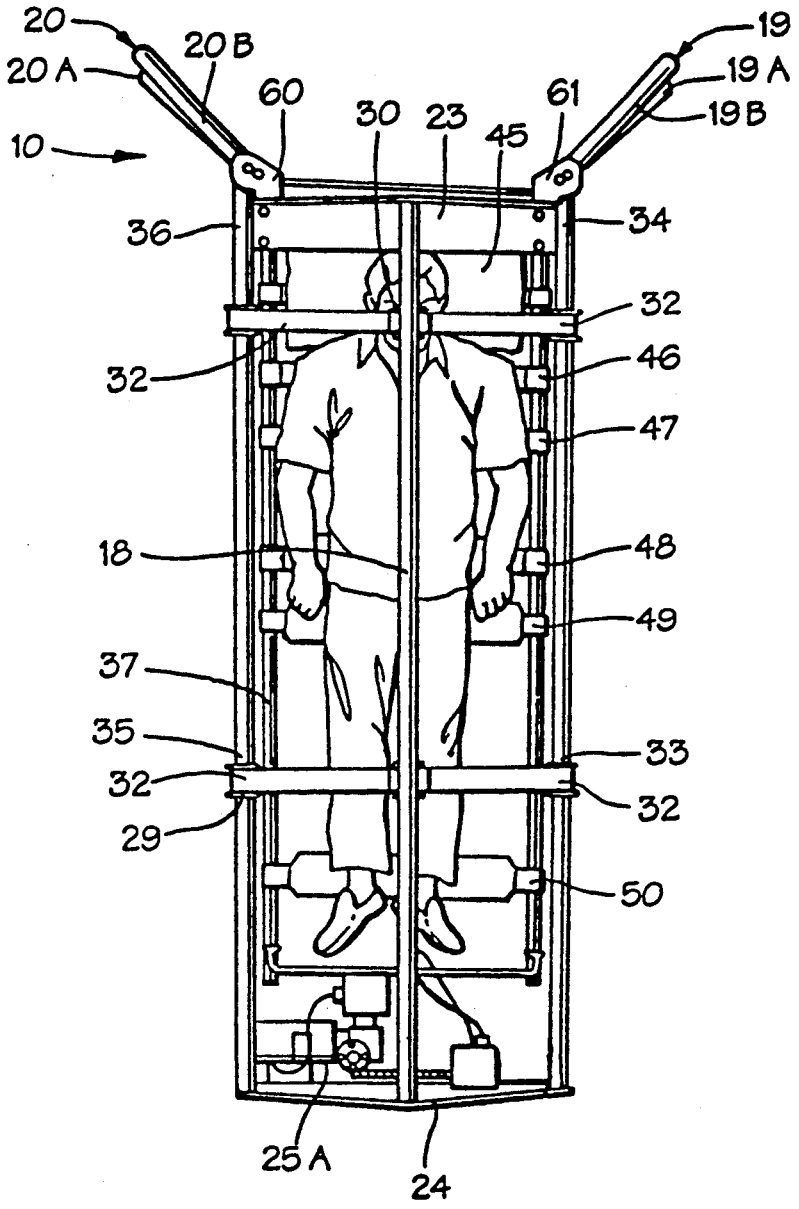
FIG. 11 is a top plan view showing the apparatus with the legs in an intermediate position which may be suitable for moving the apparatus over a bed from either the end or the side.

Notch 67B provides an intermediate position of 45 degrees, which places the legs 19, 20 in the position shown in FIG. 11. This position may be most suitable for moving the apparatus 10 over the bed from either the end or the side when space is too limited to permit the legs 19, 20 to move through their full range of motion as shown in FIGS. 9 and 10.

Figure 8:
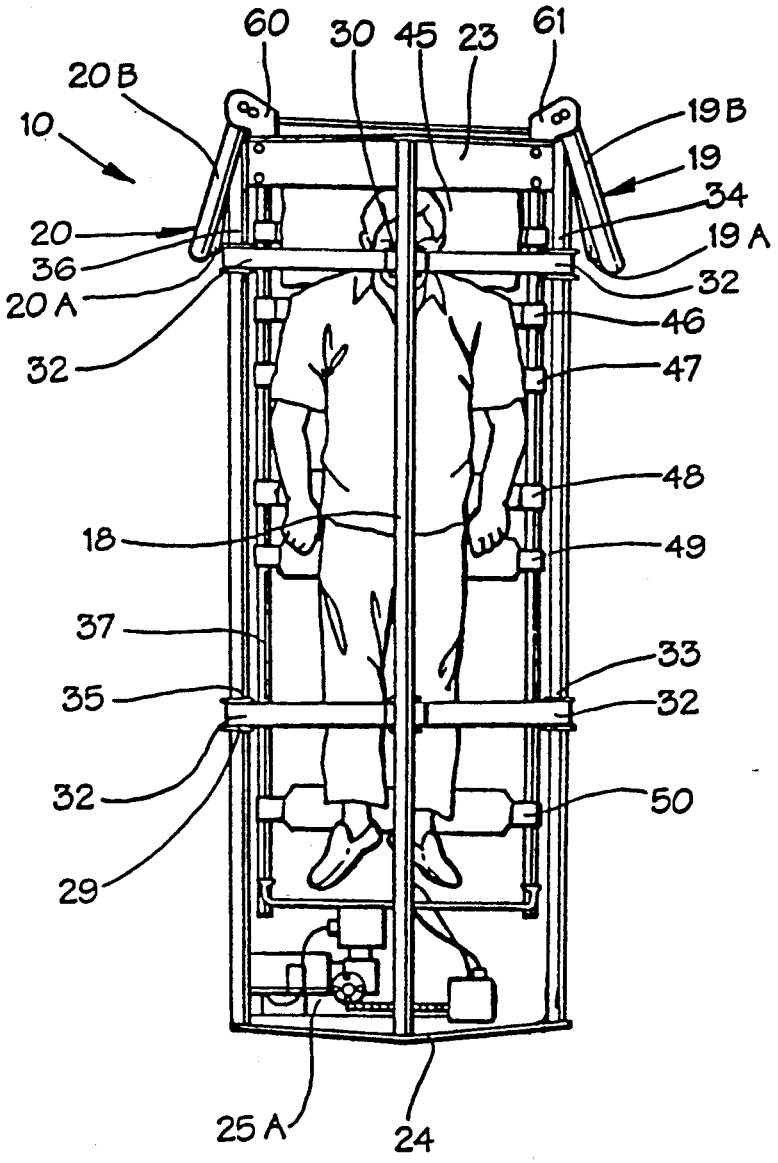
FIG. 8 is a top plan view showing the apparatus in the position for being transported by elevator.

FIG. 8 illustrates the lifting apparatus 10 in a compact configuration. In this position the length is approximately 22 inches shorter, making it much easier to maneuver the lifting apparatus 10 around corners. In this position, the lifting apparatus 10 will also fit in a standard-sized elevator of the type used in hospitals to move patients from floor to floor. The locking pin is in notch 67D, which is behind journal 60 and therefore cannot be seen.

A lifting apparatus is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A portable invalid patient lifting and turning apparatus (10) comprising, an open framework for being positioned above a bed for lifting and lowering a patient, said framework comprising:

(a) a first pair of upright standard (19, 20) mounted on rolling means;

(b) a second pair of standards (21, 22) mounted on rolling means and spaced apart from the first pair of standards;

(c) interconnecting frame members defining a lengthwise dimension of the apparatus, and connected to said first and second pairs of upright standards (19, 20), (21, 22) by opposite ends of said frame members;

(d) said first pair of standards (19, 20) being mounted for pivotal movement about a vertical axis and moveable between a:

(i) first position wherein said first pair of standards (19, 20) is positioned substantially in alignment with the length of the framework to define a space of a dimension sufficient to permit the framework to be moved laterally over a bed; and (ii) a second position wherein said first pair of standards (19, 20) is positioned in outwardly extending relation substantially perpendicular to the length of the bed for permitting the framework to be moved along is lengthwise axis over a bed, whereby the apparatus can be conveniently moved into position either from the side or the end of patient beds and moved out of position for patient transport or for movement to another patient location;

(e) elevator means supported by the open framework;

(f) patient support means being positioned on a mattress of the bed underneath patient; and (g) connecting means for connecting the patient support means and the elevator means thereby permitting the patient support means to lift the patient above the mattress surface for cleaning and bed-linen changing.

2. A portable patient lifting and turning apparatus according to claim 1, and including a third position wherein said first pair of standards (19, 20) is moveable to a position substantially 165 degrees from said first position, with the first pair of standards (19, 20) residing along the side of the interconnecting frame members in order to shorten the overall length of the apparatus to permit movement in and around tight spaces and onto elevators.

3. A portable patient lifting and turning apparatus according to claim 1, wherein said rolling means comprise casters (70).

4. A portable patient lifting and turning apparatus according to claim 1, and including locking means for locking the first pair of standards (19, 20) into the chosen first, second or third position.

5. A portable patient lifting and turning apparatus according to claim 1, wherein each of the standards (19), (20) comprising the first pair of standards comprises a first, vertical segment (80A, 80B) and a second, horizontal segment (90A, 90B), each of said standards (19), (20) being pivotally attached to said frame members by an end of the horizontal segment (90A, 90B) to provide increased distance between said first and second pairs of standards (19, 20), (21, 22) when the first pair of standards (19, 20) is in its first position, and increased distance between the standards (19), (20) of the first pair of standards when the standards (19), (20) are in the second position.

6. A portable patient lifting and turning apparatus according to claim 5, wherein said first and second standards (19), (20) of said first pair of standards each comprise first and second tubular legs (19A, 19B), (20A, 20B) joined along the length of their respective vertical segments (80A, 80B).

7. A portable patient lifting and turning apparatus according to claim 6, wherein said first and second tubular legs (19A, 19B), (20A, 20B) of respective first and second standards (19), (20) are vertically spaced-apart at the point (60) where they are attached to the frame members.

8. A portable patient lifting and turning apparatus according to claim 5, wherein said first and second standards (19), (20) of the first pair if standards each define a ninety-degree transition curve at the point where the horizontal segment (90A, 90B) and the vertical segment (80A, 80B) join together.

* * * * *